US006453817B1

(12) United States Patent
Markel et al.

(10) Patent No.: US 6,453,817 B1
(45) Date of Patent: Sep. 24, 2002

(54) SHAPED CHARGE CAPSULE

(75) Inventors: Daniel C. Markel, Pearland; Karen M. Spenley; Charles A. Sjogren, both of Houston; David E. Sewell, Kingwood, all of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/442,668

(22) Filed: Nov. 18, 1999

(51) Int. Cl.[7] ..... F42B 1/028; F42B 1/036
(52) U.S. Cl. ..... 102/306; 102/307
(58) Field of Search ..... 102/306, 307, 102/476

(56) References Cited

U.S. PATENT DOCUMENTS

| | | | | | |
|---|---|---|---|---|---|
| 2,926,603 | A | * | 3/1960 | Lindsay, Jr. | 102/310 X |
| 3,965,993 | A | * | 6/1976 | Lavigne et al. | 102/310 X |
| 4,496,008 | A | * | 1/1985 | Pottier et al. | 175/4.6 |
| 4,875,413 | A | * | 10/1989 | Christopher et al. | 102/307 |
| 4,885,993 | A | * | 12/1989 | Hancock et al. | 102/307 |
| 4,951,572 | A | * | 8/1990 | Böcker et al. | 102/307 X |
| 5,153,373 | A | * | 10/1992 | Lips et al. | 102/306 X |
| 5,460,095 | A | * | 10/1995 | Slagle et al. | 102/476 X |
| 5,505,135 | A | * | 4/1996 | Fritz et al. | 102/307 |
| 5,509,357 | A | * | 4/1996 | Lawther | 102/476 X |
| 5,656,791 | A | * | 8/1997 | Reese et al. | 102/307 |

FOREIGN PATENT DOCUMENTS

| | | | | |
|---|---|---|---|---|
| DE | 3923075 | * | 1/1991 | 102/306 |
| DE | 4001041 | * | 7/1991 | 102/306 |
| DE | 4131612 A | * | 4/1992 | 102/306 |
| GB | 839872 | * | 6/1960 | 102/306 |

* cited by examiner

*Primary Examiner*—Peter A. Nelson
(74) *Attorney, Agent, or Firm*—Trop, Pruner & Hu, P.C.; Jeffrey E. Griffin; Brigitte Jeffrey

(57) ABSTRACT

A shaped charge capsule includes an open-ended casing and a ring. The casing is adapted to house an explosive, and the casing includes a shoulder to receive a cap to close the casing. A rim of the casing at least partially surrounds the shoulder. The ring is adapted to be placed radially inside the rim and crimped with the rim to secure the cap to the casing. The ring is adapted to melt above an approximate predetermined temperature to release the cap from the casing. The cap may alternatively be secured to the casing by an adhesive that decomposes above the approximate predetermined temperature threshold.

28 Claims, 3 Drawing Sheets

SHAPED CHARGE CAPSULE

BACKGROUND

The invention relates to a shaped charge capsule.

Referring to FIG. 1, a perforating gun 8 typically is used to form tunnels in a formation to enhance the production of oil and/or gas from the formation. These tunnels are formed by detonating shaped charges that are housed by shaped charge capsules (shaped charge capsules 10*a*, 10*b* and 10*c* shown as examples) of the perforating gun 8. As depicted in FIG. 1, the shaped charge capsules typically are oriented in radially outward directions and are arranged in a helical, or spiral, phasing pattern.

Although the shaped charge typically is a secondary explosive that is difficult to detonate without the use of a primary explosive, features of the shaped charge capsule may increase the likelihood of accidental detonation. For example, the shaped charge capsule typically is hermetically sealed to prevent the hydrostatic pressure of the fluid in the well from accidentally detonating the shaped charge that is housed inside. However, if the shaped charge capsule is exposed to fire (during transport of the shaped charge capsule, for example), this seal may cause a significant increase in the internal pressure of the shaped charge capsule. This pressure buildup, in turn, may cause accidental detonation of the shaped charge.

Referring to FIG. 2, a conventional shaped charge capsule 5 that is designed to permit venting of excess internal pressure in the case of fire may include a cap 11 that covers the open end of a cup-shaped charge casing 7. A plastic ring 9 resides in an external groove of the casing 7, and the cap 11 fits over the ring 9. Due to this arrangement, the cap 11 may be crimped so that the ring 9 secures the cap 11 to the casing 7. If a fire occurs, the ring 9 melts to release the cap 11 from the casing 7 and thus, permit any internal gases to vent.

It may be desirable for the cap of the shaped charge capsule to be brittle, a characteristic that minimizes the interference of the cap with a perforation jet that is formed by the detonation of the shaped charge. Unfortunately, the above-described arrangement does not permit the cap 11 to be brittle, as the cap 11 is crimped over the ring 9 to secure the cap 11 to the casing 7.

Thus, there is a continuing need to address one or more of the above-stated problems.

SUMMARY

In one embodiment of the invention, a charge capsule includes an open-ended casing and a ring. The casing is adapted to house an explosive, and the casing includes a shoulder to receive a cap to close the casing. A rim of the casing at least partially surrounds the shoulder. The ring is adapted to be placed radially inside the rim and crimped with the rim to secure the cap to the casing. The ring is adapted to melt above an approximate predetermined temperature to release the cap from the casing.

In another embodiment, a method includes providing a ring that is adapted to melt above an approximate predetermined temperature threshold and placing the ring around the approximate periphery of a cap of a shaped charge capsule. A casing of the shaped charge capsule is crimped over the ring and the cap so that the cap is secured to the casing until a temperature of the ring exceeds the temperature threshold.

In yet another embodiment, a method includes providing an adhesive that is adapted to decompose above an approximate predetermined temperature threshold. The adhesive is used to secure a cap of shaped charge capsule to a casing of the shaped charge capsule so that the cap is secured to the casing until a temperature of the ring exceeds the temperature threshold.

Advantages and other features of the invention will become apparent from the following description, from the drawing and from the claims.

DETAILED DESCRIPTION

Figure 1:
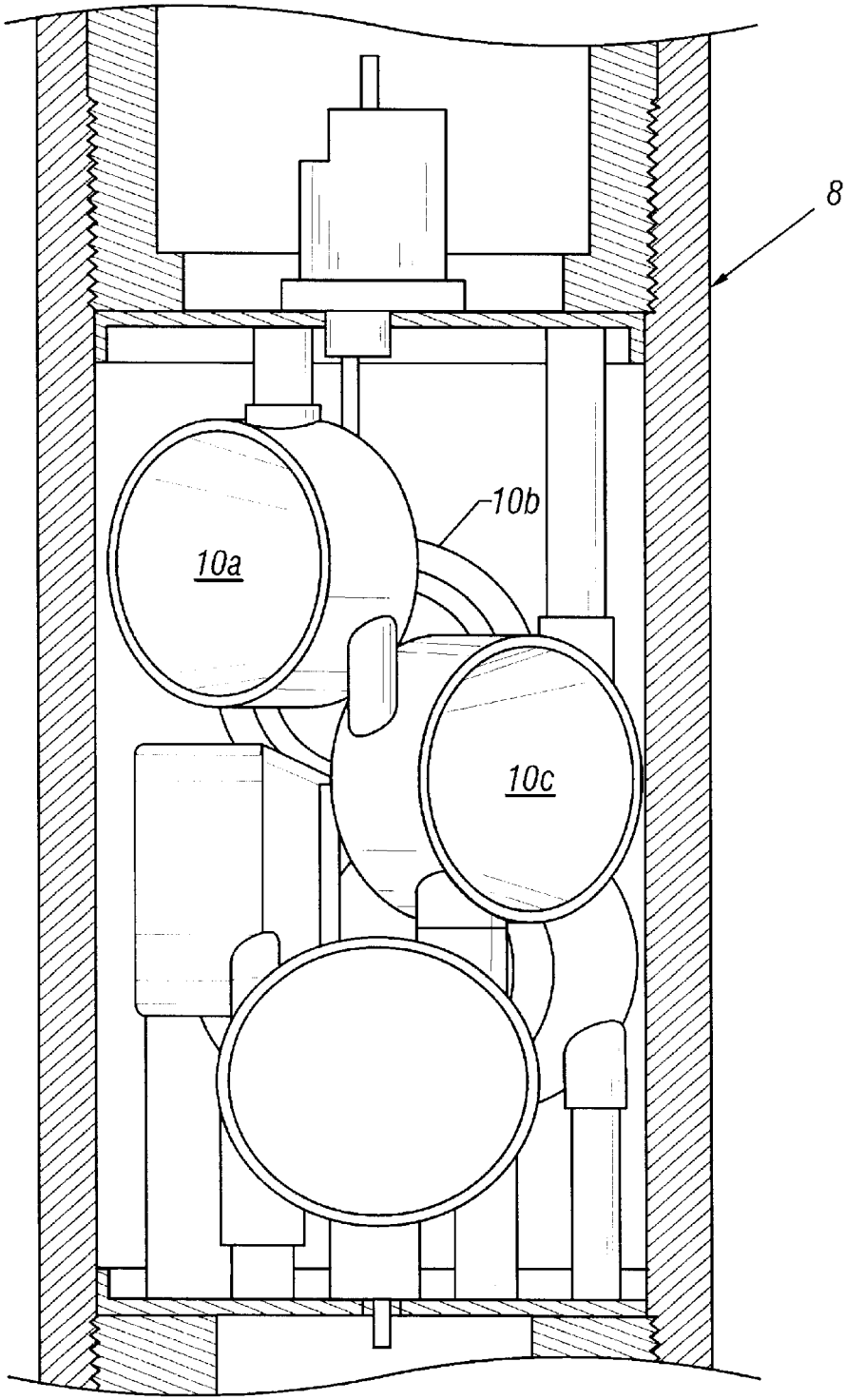
FIG. 1 (Prior Art)
FIG. 1 is a schematic diagram of a perforating gun of the prior art.
Figure 2:
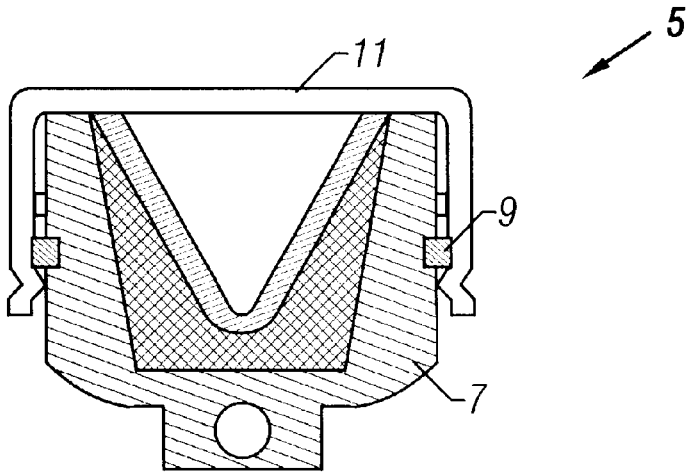
FIG. 2 (Prior Art)
FIG. 2 is a cross-sectional view of a shaped charge capsule of the prior art.
Figure 3:
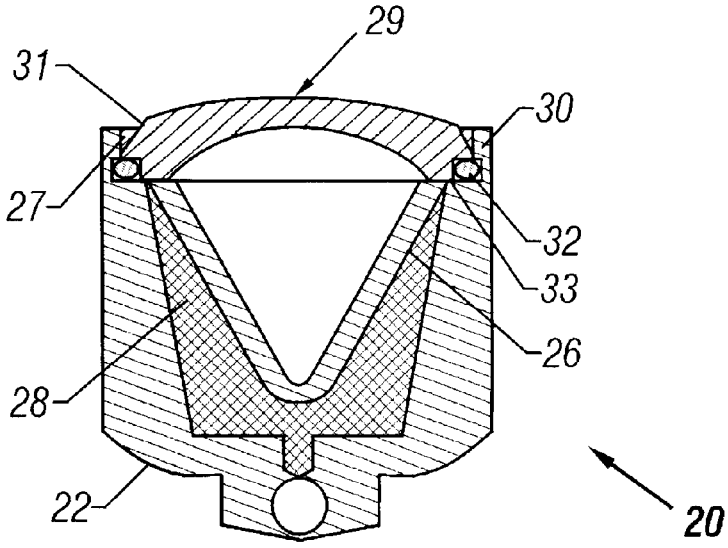
FIG. 3 is a cross-sectional view of a shaped charge capsule according to an embodiment of the invention before a rim of the capsule is crimped.

Referring to FIG. 3, an embodiment 20 of a shaped charge capsule in accordance with the invention includes a cap 29 that closes a cup-shaped, open-ended charge casing 22. Because the casing 22 (instead of the cap 29) is crimped to secure the cap 29 to the casing 22, the cap 29 may be made out of a brittle material, such as a ceramic material, a powdered metal, a high strength plastic, or a high strength composite material, as just a few examples. The brittle nature of the cap 29, in turn, causes the cap 29 to shatter into fine fragments upon detonation of the enclosed shaped charge, and thus the cap 29 does not substantially interface with the perforation jet. As described below, the shaped charge capsule 20 is adapted to release the cap 29 from the casing 22 in the case of a fire to allow pressure inside the shaped charge capsule 20 to vent.

More particularly, the casing 22 forms a rim 30 around its open end and includes an annular seat, or shoulder 33, inside the rim 30 for receiving the cap 29. For purposes of forming a hermetic seal between the cap 29 and the casing 22, an O-ring 32 may partially rest on the shoulder 33 and inside an annular groove that is formed inside the lower surface of the cap 29. A low melting point retainer ring 27 may rest on the shoulder 33 and contact the inner surface of the rim 30. In this manner, when the cap 29 is seated on the shoulder 33, the rim 30 and the ring 27 circumscribe the cap 29; and the O-ring 32 forms a seal between the shoulder 33 and the cap 29.

Figure 4:
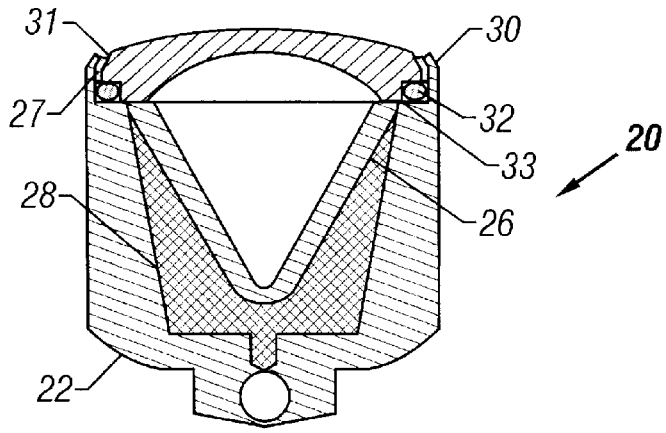
FIG. 4 is a cross-sectional view of the shaped charge capsule according to an embodiment of the invention after the rim is crimped.

Referring to FIG. 4, to secure the cap 29 to the casing 22, the rim 30 and the retainer ring 27 may be crimped over a top beveled edge 31 of the cap 29 to form an interference fit.

This interference fit, in turn, compresses the O-ring 32 between the cap 29 and the shoulder 33 to form a hermetic seal for protecting the housed shaped charge against downhole hydrostatic pressure.

The retainer ring 27 has a sufficiently low melting point so that if the temperature of the shaped charge capsule 20 exceeds a predefined temperature threshold (a temperature above approximately 450 F., for example), the retainer ring 27 melts and releases the interference fit to permit the venting of any built-up pressure inside the shaped charge capsule 20. The predefined temperature threshold is sufficiently high to prevent the release of the cap 29 during downhole operations, a release that would destroy the hermetic seal. However, the predefined threshold is low enough to melt in response to the temperature produced by a fire that might occur, for example, during transport of the shaped charge capsule 20.

Among the other features of the shaped charge capsule 20, the casing 22 may house a secondary shaped charge explosive 28. The shaped charge capsule 20 may also include a conical liner 26 that is located between the open end of the casing 22 and the explosive 28. The liner 26 forms a perforation jet upon detonation of the explosive 28.

The retainer ring 27 may be made from, as examples, a plastic or a metal (tin or lead, as examples) that has a low melting point. The casing 22 may be made out of a material that is capable of withstanding the stress of the hydrostatic pressure that is encountered by the shaped charge capsule 20 downhole. In addition, the material that forms the casing 22 is capable of withstanding the downhole temperatures of the well.

Figure 5:
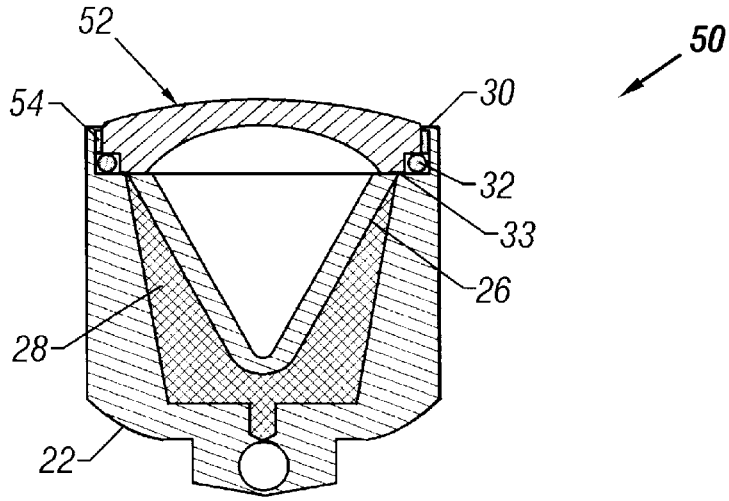
FIG. 5 is a cross-sectional view of a shaped charge capsule according to an embodiment of the invention.

Referring to FIG. 5, in some embodiments, a shaped charge capsule 50 may be used in place of the shaped charge capsule 20. The shaped charge capsule 50 has similar features to the shaped charge capsule 20, with the differences being pointed out below. In particular, the shaped charge capsule 50 does not include a low melting point retainer ring. Instead, an adhesive 54 may be used to bond a cap 52 (that replaces the cap 29) of the shaped charge capsule 50 to the rim 30, and as a result, crimping of the rim 30 may not be required to perfect the hermetic seal. Similar to the cap 29, the cap 52 may be made out of a brittle material and may include an annular groove for receiving the O-ring 32. However, the cap 52 may have a shape that allows more of the outer surface area of the cap 52 to contact the inner surface of the rim 30 to form a sufficient bond between the rim 30 and the cap 52.

To seal the shaped charge capsule 50, the adhesive 54 is applied to the inner surface of the rim 30. Next, the cap 52 is seated on the shoulder 33 and over the O-ring 32 that is partially located in the annular groove of the cap 52. A downward force may be subsequently applied to the cap 52 to compress the O-ring 32 until the adhesive 54 cures and holds the O-ring 32 in its compressed state. In some embodiments, the adhesive 54 decomposes (melts, for example) at a sufficiently high temperature (a temperature near 450° F, for example) so that the adhesive bond between the cap 52 and the rim 30 fails in the event of a fire. The failure of the adhesive bond releases the hermetic seal between the cap 52 and the casing 22. However, the decomposition temperature of the adhesive 54 is high enough to provide a sufficient bond to perfect the hermetic seal for the temperatures encountered downhole.

Figure 6:
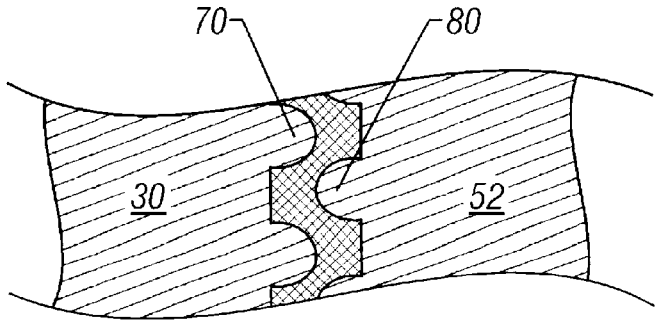
FIG. 6 is a detailed view of adjacent surfaces of a rim and a cap of the shaped charge capsule of FIG. 5 according to an embodiment of the invention.

Referring to FIG. 6, in some embodiments, the rim 30 may have inward extensions, such as annular ridges 70, that are adapted to form an approximate interlocking relationship with corresponding outward extensions, such annular ridges 80, of the cap 52. The ridges 70 and 80 provide additional surface area to form the adhesive bond between the cap 52 and the rim 30.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. A shaped charge capsule comprising:

an open-ended casing adapted to house an explosive, the casing including a shoulder to receive a cap to close the casing and a rim at least partially surrounding the shoulder; and a ring adapted to be placed radially inside the rim and crimped with the rim to secure the cap to the casing the ring adapted to melt above an approximate predetermined temperature to release the cap from the casing.

2. The shaped charge capsule of claim 1, wherein the ring comprises a material adapted to melt when a temperature of the material exceeds a temperature above approximately 450° F.

3. The shaped charge capsule of claim 1, wherein the cap comprises a brittle material.

4. The shaped charge capsule of claim 1, wherein the ring comprises a plastic.

5. The shaped charge capsule of claim 1, wherein the ring comprises lead.

6. The shaped charge capsule of claim 1, wherein the ring comprises tin.

7. A shaped charge capsule comprising:

an open-ended casing adapted to house an explosive;

a cap; and an adhesive adapted to secure the cap to the casing and decompose above an approximate predetermined temperature to release the cap from the casing.

8. The shaped charge capsule of claim 7, wherein the adhesive is adapted to decompose above approximately 450° F.

9. The shaped charge capsule of claim 7, wherein the cap comprises a brittle material.

10. The shaped charge capsule of claim 7, wherein the casing includes extensions adapted to provide additional surface area for an adhesive bond between the casing and the cap.

11. The shaped charge capsule of claim 10, wherein the cap includes other extensions adapted to form an interlocking relationship with the extensions of the casing.

12. The shaped charge capsule of claim 7, wherein the cap includes extensions adapted to provide additional surface area for an adhesive bond between the casing and the cap.

13. A method comprising:

providing a ring that is adapted to melt above an approximate predetermined temperature threshold;

placing the ring around the approximate periphery of a cap of a shaped charge capsule; and crimping a casing of the shaped charge capsule over the ring and the cap so that the cap is secured to the casing until a temperature of the ring exceeds the temperature threshold.

14. The method of claim 1, wherein the predetermined temperature threshold is approximately 450° F.

15. A method comprising:

providing an adhesive that is adapted to decompose above an approximate predetermined temperature threshold; and using the adhesive to secure a cap of shaped charge capsule to a casing of the shaped charge capsule so that the cap is secured to the casing until a temperature of the ring exceeds the temperature threshold.

16. The method of claim 15, wherein the adhesive is adapted to decompose above approximately 450° F.

17. A shaped charge capsule comprising:

a cap;

an open-ended casing adapted to house an explosive, the casing including a shoulder to receive the cap to close the casing and a rim at least partially surrounding the shoulder; and a ring placed radially inside the rim and crimped with the rim to secure the cap to the housing, the ring adapted to melt above an approximate predetermined temperature to release the cap from the housing.

18. The shaped charge capsule of claim 17, wherein the ring comprises a material adapted to melt when a temperature of the material exceeds a temperature above approximately 450° F.

19. The shaped charge capsule of claim 17, wherein the cap comprises a brittle material.

20. The shaped charge capsule of claim 17, wherein the ring comprises a plastic.

21. The shaped charge capsule of claim 17, wherein the ring comprises lead.

22. The shaped charge capsule of claim 17, wherein the ring comprises tin.

23. A shaped charge capsule comprising:

an open-ended casing adapted to house an explosive;

a cap; and an adhesive to secure the cap to the casing and decompose above an approximate predetermined temperature to release the cap from the casing.

24. The shaped charge capsule of claim 23, wherein the adhesive is adapted to decompose above approximately 450° F.

25. The shaped charge capsule of claim 23, wherein the cap comprises a brittle material.

26. The shaped charge capsule of claim 23, wherein the casing includes extensions adapted to provide additional surface area for an adhesive bond between the casing and the cap.

27. The shaped charge capsule of claim 25, wherein the cap includes other extensions adapted to form an interlocking relationship with the extensions of the casing.

28. The shaped charge capsule of claim 23, wherein the cap includes extensions adapted to provide additional surface area for an adhesive bond between the casing and the cap.

* * * * *

UNITED STATES PATENT AND TRADEMARK OFFICE

CERTIFICATE OF CORRECTION

PATENT NO. : 6,453,817 B1 
DATED : September 24, 2002
INVENTOR(S) : Daniel C. Markel et al.

It is certified that error appears in the above-identified patent and that said Letters Patent is hereby corrected as shown below:

Column 4,
Line 12, "casing" should be -- casing, --

Signed and Sealed this

Eighteenth Day of February, 2003

JAMES E. ROGAN
*Director of the United States Patent and Trademark Office*